United States Patent [19]

Smith

[11] Patent Number: 4,706,307

[45] Date of Patent: Nov. 17, 1987

[54] FLOATING POOL ASSEMBLY

[76] Inventor: John L. Smith, 3775 Kent Dr., Troy, Mich. 48084

[21] Appl. No.: 489,140

[22] Filed: May 4, 1983

Related U.S. Application Data

[63] Continuation of Ser. No. 207,922, Nov. 18, 1980, abandoned.

[51] Int. Cl.[4] ..... E04H 3/18

[52] U.S. Cl. ..... 4/487; 4/506

[58] Field of Search ..... 4/487–489, 4/492, 493, 496, 498, 499, 505–507, 513, 514; 405/67, 68, 70, 72

[56] References Cited

U.S. PATENT DOCUMENTS

| | | | |
|---|---|---|---|
| 2,896,221 | 7/1959 | Thomas | 4/507 |
| 3,621,496 | 11/1971 | McWilliams | 4/505 |
| 3,640,073 | 2/1972 | Samsel | 4/487 X |
| 3,710,577 | 1/1973 | Matheson | 405/72 X |
| 3,792,589 | 2/1974 | Sayles | 405/72 X |
| 3,922,732 | 12/1975 | Friedel | 4/493 |
| 4,000,532 | 1/1977 | Nielsen | 405/70 X |
| 4,100,746 | 7/1978 | Preus | 4/487 X |
| 4,126,905 | 11/1978 | Russell et al. | 4/488 |
| 4,149,281 | 4/1979 | Bob et al. | 4/171 |

FOREIGN PATENT DOCUMENTS

| | | | |
|---|---|---|---|
| 935393 | 11/1955 | Fed. Rep. of Germany | 4/506 |
| 801950 | 9/1958 | United Kingdom | 4/506 |

*Primary Examiner*—Charles E. Phillips

*Attorney, Agent, or Firm*—Reising, Ethington, Barnard, Perry & Milton

[57] ABSTRACT

A floating pool assembly including a sheet member having top and bottom extremities and first and second ends, the first and second ends being connected together to define an endless wall with an open top and open bottom. The sheet member is flexible for folding and unfolding. The assembly further includes a floatation pocket extending along the top extremity between the ends of the sheet member, a weight pocket extending along the bottom extremity between the ends of the sheet member, and a fluid pocket extending between the ends of the sheet member below the floatation pocket. The fluid pocket has closed ends and spaced openings therealong and an inlet which communicates with the fluid pocket for supplying fluid to the fluid pocket for flow out of the openings. When the assembly is disposed within a pool and the supplied fluid is hot water coming from the pool water heating system, the assembly provides an isolated heated area within the pool.

A method of forming the floating pool assembly is also disclosed and includes the steps of forming the floatation pocket extending along the top extremity between the ends of the sheet, forming the weight pocket extending along the bottom extremity between the ends of the sheet, forming a fluid pocket extending between the ends below the floatation pocket, securing an inlet to the fluid pocket for supplying fluid to the pocket, and connecting the first and second ends of the sheet together to define an endless wall with an open top and open bottom.

19 Claims, 6 Drawing Figures

FLOATING POOL ASSEMBLY

This application is a continuation of application Ser. No. 207,922, filed 11-18-80, now abandoned.

BACKGROUND OF THE INVENTION

1. Field of the Invention

The instant invention relates to a floating structure used as an accessory for a swimming pool which creates an isolated heated water area in the pool. The instant invention utilizes the existing water circulation system and heating system of the pool.

2. Description of the Prior Art

Various devices are taught by the prior art for isolating an area of water within a larger body of water.

Several constructions are adapted for providing an enclosed swimming area within a lake along or near the shore. These constructions cannot be adapted for providing a small leisure area within a small body of water such as a swimming pool.

Other prior art constructions have been designed specifically for swimming pools. These constructions have been either dividers for dividing portions of the pool water from the main body of water or tubs which float on the water surface. These constructions are quite elaborate and bulky and are not easily stored or shipped.

Unlike the prior art, the instant invention provides an economically inexpensive means for providing a floating pool assembly which can be easily folded, stored, and shipped. The instant invention further provides a novel method of constructing the floating pool assembly.

SUMMARY OF THE INVENTION

The instant invention provides a floating pool assembly including a sheet member having first and second ends and top and bottom extremities, the sheet member being flexible for folding and unfolding. A floatation pocket extends along the top extremity between the ends of the sheet member and a weight pocket extends along the bottom extremity between the ends of the sheet member. The sheet member defines a fluid pocket extending between the ends below the floatation pocket, the fluid pocket having closed ends and spaced openings therealong. A fluid pocket inlet communicates with the fluid pocket for supplying fluid to the fluid pocket for flow out of the openings. Connecting means are disposed at the first and second ends and connect the first and second ends together to define an endless wall with an open top and open bottom.

The instant invention further provides a novel method for forming the floating pool assembly including the steps of first forming the floatation pocket extending along the top extremity between the ends of the sheet. A weight pocket is formed extending along the bottom extremity between the ends of the sheet. A fluid pocket is next formed extending between the ends below the floatation pocket, the fluid pocket having closed ends and spaced openings therealong. An inlet is secured to the fluid pocket for supplying fluid to the pocket. Finally, the first and second ends are connected together to define an endless wall with an open top and an open bottom.

PRIOR ART STATEMENT

The U.S. Pat. No. 3,922,732 to Friedel issued Dec. 2, 1975 teaches a floating heat barrier consisting of floats atop side walls which extend down into the water the bottom edges of which are anchored to a lake bottom. The Friedel patent does not teach a divider which can be easily adapted to provide a small leisure area within a swimming pool and which can also be easily folded, shipped or stored.

The U.S. Pat. Nos. 4,126,905 to Russell et al issued Nov. 28, 1978 and 4,149,281 to Bob et al issued Apr. 17, 1979 relate to floating hot water spas. These systems provide isolated hot water spas within the larger pool area. The instant invention provides an economical advantage over these prior art constructions by providing a lower-cost assembly which can be easily stored and shipped. Additionally, the instant invention provides an open system wherein the hot water supplied to the assembly is allowed to circulate to the remainder of the pool thereby concentrating the hot water within the assembly and additionally heating the remainder of the pool without the water having to first recirculate through the heating system.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENT

A floating pool assembly constructed in accordance with the instant invention is generally shown at 10.

Figure 1:
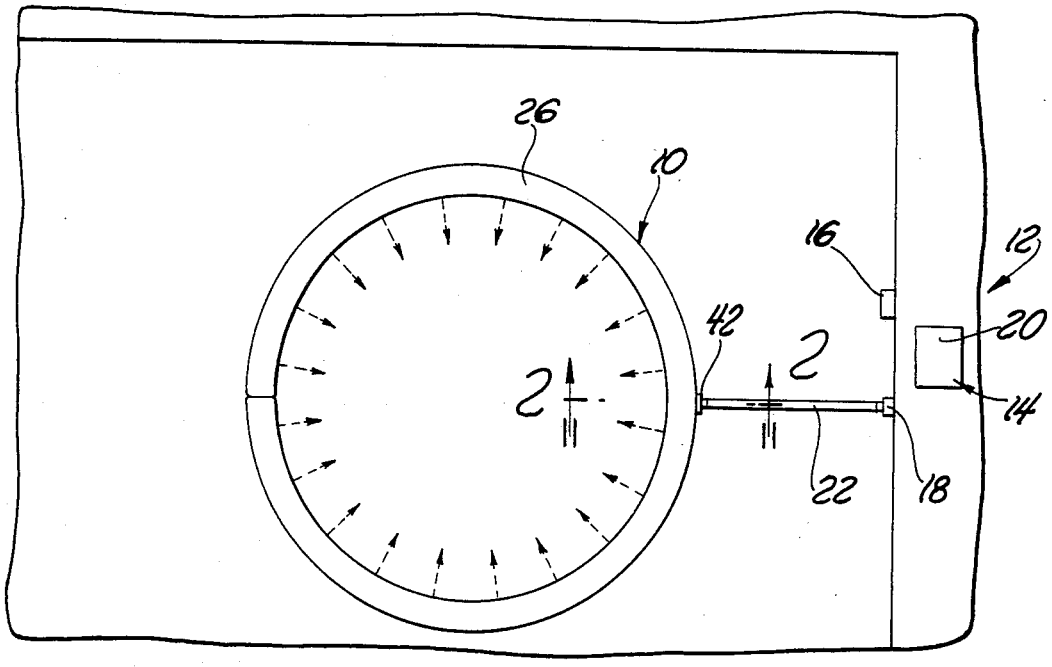
FIG. 1 is a top plan view of the instant invention disposed within a swimming pool.

FIG. 1 shows the instant invention 10 disposed within a swimming pool, generally indicated at 12. The swimming pool 12 includes an inlet and outlet pool water circulation system generally indicated at 14 receiving pool water from the pool outlet 16 and returning pool water to the pool inlet 18, which inlet would normally supply water to the pool 12. The circulation system 14 further includes a heater 20 for heating the water normally returned to the pool 12 through the inlet 18.

The instant invention 10 is operatively connected to the circulation system inlet 18 by a conduit 22. The conduit 22 is a flexible member, such as a hose, for conveying hot water between the inlet 18 of the circulation system 14 and the instant invention 10.

The floating pool assembly 10 includes a sheet member 24. The sheet member 24 is flexible for folding and unfolding. In the preferred embodiment of the instant invention, the sheet member 24 is made from a lightweight, flexible plastic, canvas or cloth which, when unassembled, can be easily folded.

Figure 4:
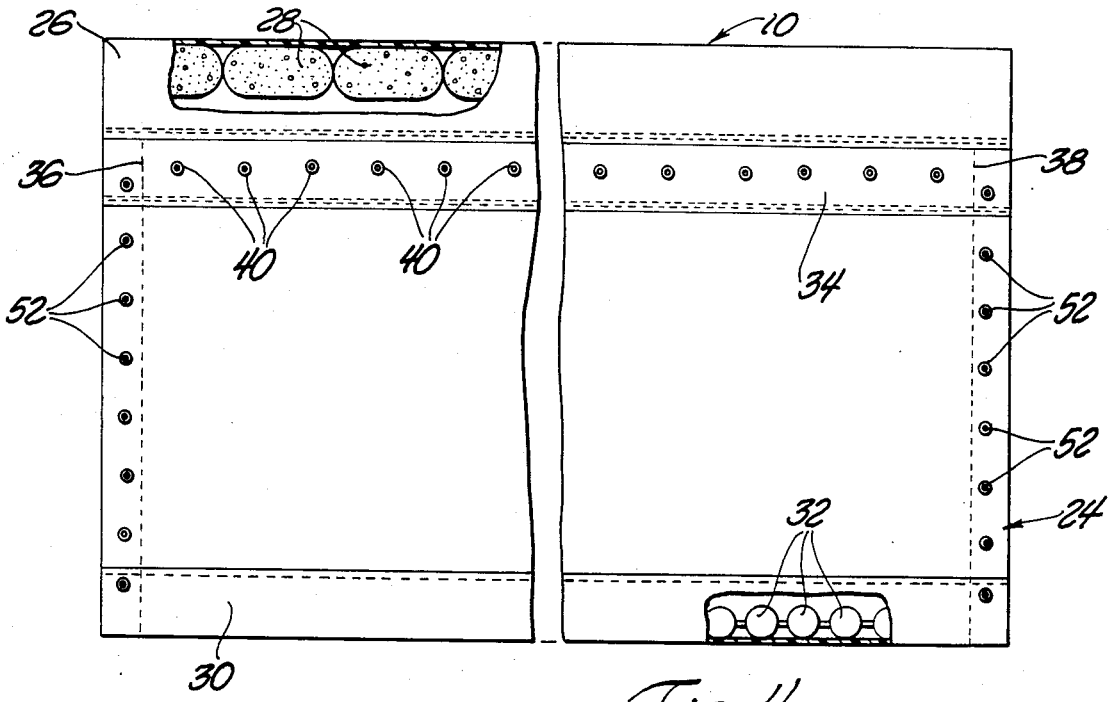
FIG. 4 is a partially, broken away, elevational view of the sheet member of the instant invention.
Figure 5:
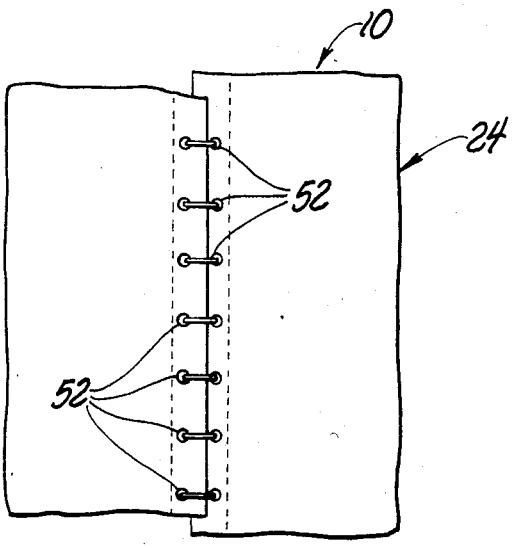
FIG. 5 is a fragmentary view of the ends of the sheet member connected together in accordance with the instant invention.
Figure 6:
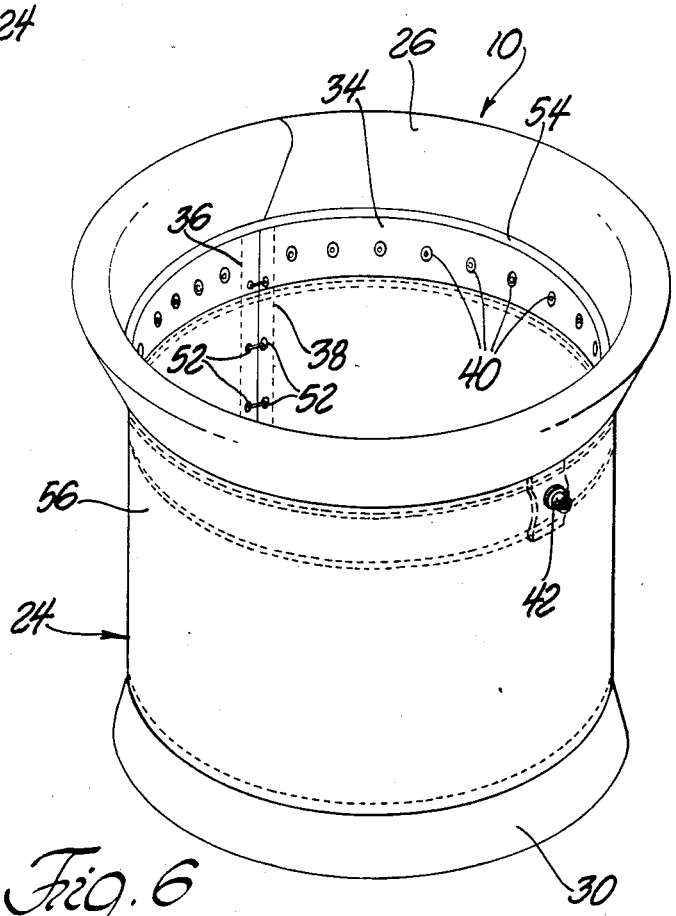
FIG. 6 is a perspective view of the instant invention.

A floatation means extends along the top extremity of the sheet member 24 between the ends of the sheet member 24. In the preferred embodiment, the floatation means comprises a floatation pocket 26 and a buoyant material 28 is disposed in the floatation pocket 26. The floatation pocket 26 is flexible for allowing the sheet member 24 to extend in an endless path as the ends of the sheet member 24 are connected together. As shown in FIG. 4, the preferred embodiment of the instant invention includes a plurality of cylindrical, buoyant, styrofoam members 28 having hemispherical ends disposed within the floatation pocket 26. The hemispherical ends of the styrofoam members 28 provide flexibility of the floatation pocket 26 for allowing the sheet member 24 to be formed into its final configuration wherein the ends of the sheet member 24 are connected together. The spherical ends rotate against one another in their end to end disposition so that their total aggregated length does not increase as the assembly is formed into a closed loop from the flat configuration. The floatation pocket may include buoyant materials such as urethane or gases, such as air.

The floating pool assembly 10 further includes a weight pocket 30 extending along the bottom extremity of the sheet member 24 between the ends thereof. Weighted material 32 is disposed in the weight pocket 30 and is flexible for allowing the sheet member 24 to extend in an endless path as the ends of the sheet member 24 are connected together. As shown in FIG. 4, the weighted material 32 consists of a string of lead beads connected together by a nylon string. The string of lead beads 32 is disposed completely about the weight pocket 30. Alternatively, the lead beads could be disposed within a thin flexible tube inside of the weight pocket.

The sheet member 24 defines a fluid pocket 34 extending between the ends of the sheet member 24 below the floatation pocket 26. The fluid pocket has closed ends 36 and 38. The fluid pocket 34 further includes spaced openings 40 therealong. Grommets or similar ring-like retainers are disposed about the openings 40.

A fluid pocket inlet 42 communicates with the fluid pocket 34 for supplying fluid to the fluid pocket 34 for flow out of the openings 40. In other words, heated water from the water circulation system 14 travels from the inlet 18 via the conduit 22 to the fluid pocket inlet 42 of the floating pool assembly 10. The heated water travels through the fluid pocket 34 and escapes through the openings 40 into the center of inner area of the floating pool assembly 10 as designated by the arrows in FIG. 1. Thusly, a hot water thermal area is created within the floating pool assembly 10.

The weighted material 32 within the weight pocket 30 weighs down the bottom of the floating pool assembly 10. The weight pocket 30 does not, however, perfect a seal with the pool bottom. Thusly, the heated water within the floating pool assembly 10 escapes from under the weight pocket 30 thereby heating the remainder of the pool. Hence, the instant invention provides an open system wherein heated water from the water circulation system 14 is first concentrated within the floating pool assembly 10 and then escapes from the floating pool assembly 10 to heat the remainder of the pool 12.

Figure 2:
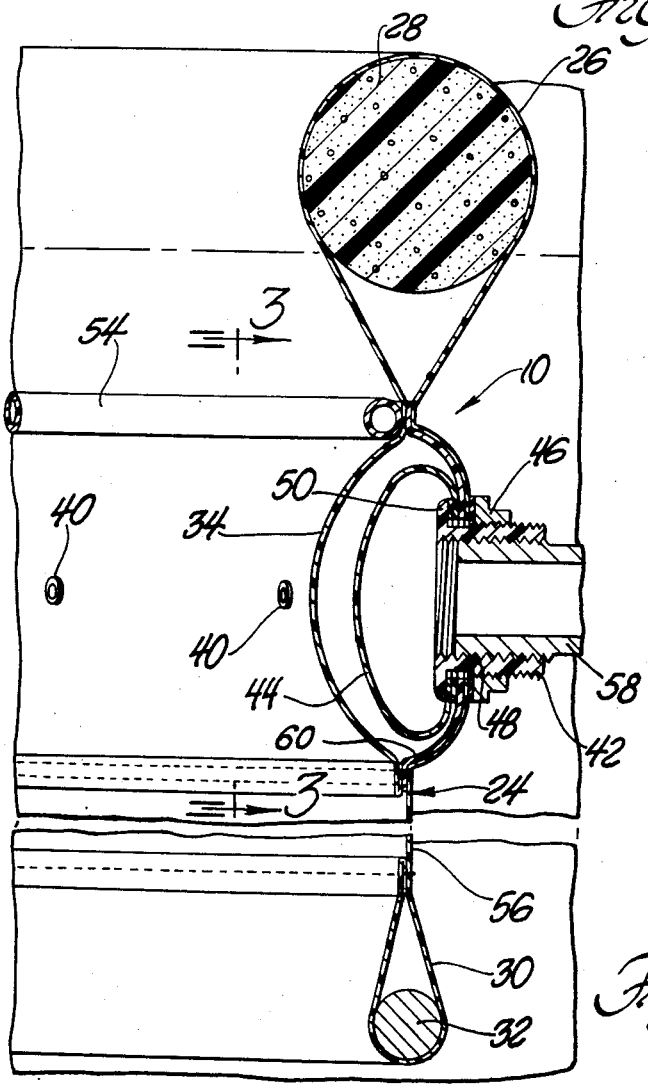
FIG. 2 is an enlarged fragmentary cross-sectional view taken substantially along lines 2—2 of FIG. 1.
Figure 3:
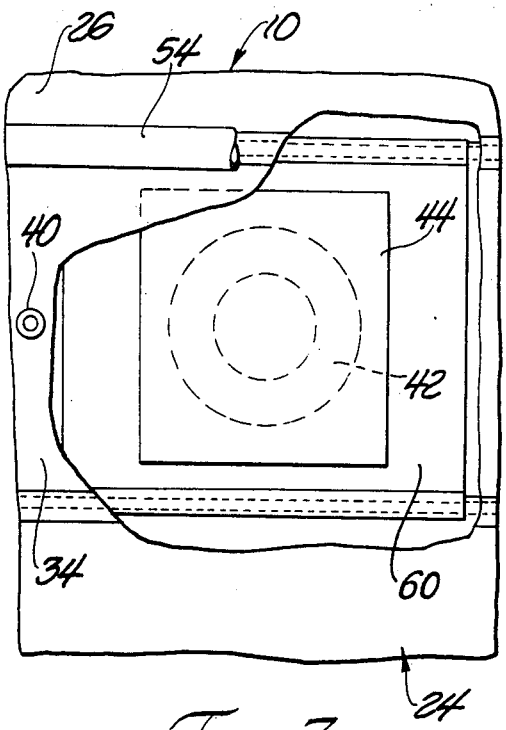
FIG. 3 is an enlarged, partially broken away elevational view taken substantially along lines 3—3 of FIG. 2.

As shown in FIGS. 2 and 3, a baffle 44 is secured about the fluid pocket inlet 42. The baffle 44 forces the incoming water to move laterally through the fluid pocket 34 and not bulge the fluid pocket 34 immediately adjacent the fluid pocket inlet 42.

As shown in FIG. 2, the fluid pocket inlet 42 consists of a threaded member having inside threads for receiving a connecting fitting 58 for the conduit 22 extending from the water circulation system inlet 18. The fluid pocket inlet 42 also has a threaded outer portion for threadedly engaging the interior of a fitting 46. The sheet member 24 has an opening 48 therein. The inlet member 42 and fitting 46 are threadedly engaged so as to clamp the material about the opening 48 and the baffle member 44 between the lip 50 of the inlet 42 and the nut 46. As shown in FIGS. 2 and 3, an inlet reinforcement 60 may be sewn about the fluid pocket inlet 42 to prevent tearing at the highly stressed inlet area.

The instant invention further includes a plurality of eyelets 52 extending along each of the first and second ends of the sheet member 24 for lacing the ends together to define an endless wall with an open top and bottom. Of course, other means for connecting the ends of the sheet member 24 can be used, such as a zipper or snaps.

A circular, semi-rigid hoop member 54 is disposed within and engages the interior of the sheet member 24 vertically between the floation pocket 26 and the fluid pocket 34 to maintain the sheet member 24 in a predetermined cylindrical shape. Alternatively, the hoop can be of other shapes, such as a square or oblong shape.

In operation, heated water from the pool water circulation system 14 enters the inlet 42 of the fluid pocket 34. It is deflected laterally by the baffle 44 through the fluid pocket 34. The water escapes via the inlets 40 into the inner area defined by the sheet member 24.

The assembly floats in the pool 12 and the weighted material 32 weighs down the sheet member 24. The sheet member 24 provides a curtain 56 extending between the fluid pocket 34 and the weight pocket 30. A person can enter the floating pool assembly by either stepping into it from the top, or by submerging the floatation pocket 26 and swimming in, or by swimming under the flexible weight pocket 30. Thusly, the assembly 10 provides an area of concentrated heated water for leisurely relaxation by its occupant(s). The instant invention further provides an open system whereby the heated water therewithin escapes from below the weight pocket 30 so as to heat the remainder of the pool.

The instant invention further provides a novel method of forming a floating pool assembly. The method includes first forming the weight pocket 30 extending along the bottom extremity between the ends of the sheet member 24 by forming an upwardly extending fold at the bottom extremity of the sheet 24 and securing the end of the upwardly extending fold to the sheet member 24. In the preferred embodiment of the instant invention, the end of the fold is sewn to the sheet member 24. The lead beads 32 may be disposed within the fold during the folding and sewing process or, once the pocket 30 is made, the end of the string of weights may be pulled through the pocket so as to dispose the string of lead beads 32 therewithin. The ends of the weight pocket 30 may be sewn closed when the weights are disposed therein as the pocket is formed.

The second step is to form the floatation pocket 26 extending along the top extremity between the ends of the sheet 24 by forming a downwardly extending fold at the upper extremity of the sheet member 24 and securing the fold to the sheet member 24 along a line suitably spaced from the edge of the fold.

The next step is to secure the fluid pocket inlet 42 and the baffle 44 to the sheet member 24 at opening 48.

Then, the fluid pocket is formed by securing the edge of the downwardly extending fold to the sheet member 24. The ends of the fluid pocket 34 are then sewn closed.

Of course, these steps may be performed in various sequences.

The assembly may be shipped with the sheet folded in a package with the floatation material and an unassembled segmented hoop and with the weights in or out of the weight pocket. For use, one would insert the floatation material into the floatation pocket and connect the first and second ends of the sheet member 24 together to form an endless wall with an open top and bottom. Once the ends are connected together, the semi-rigid shaping member 54, having a periphery generally the same length as the length of the periphery of the sheet member 24 when the ends thereof are connected together, is assembled by fitting the hoop segments together and is then disposed within the interior of the sheet member 24 between the floatation pocket 26 and the fluid pocket 34.

As stated above, the assembly can be shipped as a folded sheet of material along with the separate bouyant members 28 and the hoop member 54. The hoop member can be constructed in several parts such that the parts fit together to form a hoop. Thusly, the instant invention provides a floating pool assembly which is relatively light in weight, can be easily shipped and which provides an economical in-pool thermal oasis.

The invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are not to be in any way limiting, the invention may be practiced otherwise than as specifically described.

The embodiments of the invention in which an exclusive property or privilege is claimed are defined as follows:

1. A floating pool assembly (10) comprising; sheet means (24) having first and second ends and top and bottom extremities, said sheet means (24) being flexible for folding and unfolding; flexible floatation means (26) extending along said top extremity between said ends of said sheet means (24) for providing buoyancy, said sheet means (24) defining a fluid pocket (34) extending between said ends below said floatation means (26), said fluid pocket (34), having closed ends and spaced openings (40) therealong; a fluid pocket inlet (42) communicating with said fluid pocket (34) for supplying fluid to said fluid pocket (34) for flow out of said openings (40); connecting means (52) at said first and second ends for connecting said first and second ends together to define an endless wall with an open top and an open bottom; and shaping means (54) having a predetermined shape coacting with said sheet means (24) and said floatation means (26) for maintaining said floatation means (26) in said predetermined shape about the periphery of said top extremity and for allowing said sheet means (24) to freely depend from said floatation means (26) about the periphery thereof.

2. An assembly as set forth in claim 1 including weight means (30) extending along said bottom extremity between said ends of said sheet means (24) for providing a weight to said bottom extremity.

3. An assembly as set forth in claim 2 wherein said weight means (30) includes a weight pocket (30) extending along said bottom extremity between said ends of said sheet means (24).

4. An assembly as set forth in claim 3 wherein said shaping means (54) comprises a circular hoop (54) for engaging the interior of said sheet means (24) between said floatation means (26) and said fluid pocket (34).

5. An assembly as set forth in claim 1 wherein said floatation means comprises a floatation pocket (26) and buoyant material (28) disposed in said floatation pocket (26) and being flexible for allowing said sheet means (24) to extend in an endless path as said ends of said sheet means (24) are connected together.

6. An assembly as set forth in claim 5 including weight means (30) extending along said bottom extremity between said ends of said sheet means (24) for providing a weight to said bottom extremity.

7. An assembly as set forth in claim 6 wherein said weight means (30) includes a weight pocket (30) extending along said bottom extremity between said ends of said sheet means (24).

8. An assembly as set forth in claim 7 including weight material (32) disposed in said weight pocket (30) and being flexible for allowing said sheet means (24) to extend in an endless path as said ends of said sheet means (24) are connected together.

9. An assembly as set forth in claim 8 wherein said shaping means (54) comprises a circular hoop (54) for engaging the interior of said sheet means (24) between said floatation pocket (26) and said fluid pocket (34).

10. An assembly as set forth in claim 8 including a baffle (44) inside of said fluid pocket (34) facing said fluid pocket inlet (42).

11. An assembly as set forth in claim 10 wherein said connecting means (52) comprises a plurality of eyelets (52) along each of said first and second ends for lacing said ends together.

12. A floating pool assembly (10) comprising: a sheet member (24) having first and second ends and top and bottom extremities, said sheet member (24) being flexible for folding and unfolding; a flexible floatation pocket (26) extending along said top extremity between said ends of said sheet member (24); a plurality of cylindrical buoyant members (28) having hemispherical ends disposed within said floatation pocket (26), said hemispherical ends providing flexibility of said floatation pocket (26) for allowing said sheet member (24) to extend in an endless path as said ends of said sheet member (24) are connected together; a weight pocket (30) extending along said bottom extremity between said ends of said sheet member (24); weighted material (32) disposed in said weight pocket (30) and being flexible for allowing said sheet member (24) to extend in an endless path as said ends of said sheet member (24) are connected together, said sheet member (24) defining a fluid pocket (34) extending between said ends below and adjacent to said fluctuation pocket (26), said fluid pocket (34) having closed ends (36, 38) and spaced openings (40) therealong; a fluid pocket inlet (42) communicating with said fluid pocket (34) for supplying fluid to said fluid pocket (34) for flow out of said openings (40); a baffle (44) inside of said fluid pocket (34) facing said fluid pocket inlet (42); a circular hoop member (54) for coacting with said sheet member (24) and said floatation pocket (26) to maintain said floatation pocket (26) in a predetermined shape about the periphery of said top extremity and to allow said sheet member (24) to freely depend from said floatation pocket (26) about the periphery thereof; and a plurality of eyelets (52) along each of said first and second ends for lacing said ends together to define an endless wall with an open top and an open bottom.

13. A swimming pool (12) comprising: an inlet and outlet pool water circulation system (14) for receiving pool water from said outlet (16) and returning pool water through said inlet (18) to said pool (12) and including a heater (20) for heating the water returned to the pool (12) through said inlet (18); sheet means (24) having first and second ends and top and bottom extremities for defining a closed area within said pool (12), said sheet means (24) being flexible for folding and unfolding; a flexible floatation pocket (26) extending along said top extremity between said ends of said sheet means (24); a weight pocket (30) extending along said bottom extremity between said ends of said sheet means (24), said sheet means (24) defining a fluid pocket (34) extending between said ends below said floatation pocket (26), said fluid pocket (34) having closed ends (36, 38) and spaced openings therealong; a fluid pocket inlet (42) communicating with said fluid pocket (34) for supplying fluid to said fluid pocket (34) for flow out of said openings; conduit means (22) operatively connecting said inlet (18) of said circulation system to said fluid pocket inlet (42) for supplying heated water from said circulation system (14) to said fluid pocket (34); connecting means (52) at said first and second ends connecting said first and second ends together to define an endless wall with an open top and an open bottom; and shaping means (54) having a predetermined shape co-acting with said sheet means (24) and said floatation means (26) for maintaining said floatation means (26) in said predetermined shape about the periphery of said top extremity and for allowing said sheet means (24) to freely depend from said floatation means (26) about the periphery thereof.

14. An assembly as set forth in claim 13 wherein said shaping means (54) comprises a circular hoop (54) for engaging the interior of said sheet means (24) between said floatation pocket (26) and said fluid pocket (34).

15. An assembly as set forth in claim 13 including buoyant material (28) disposed in said floatation pocket (26) and being flexible for allowing said sheet means (24) to extend in an endless path as said ends of said sheet means (24) are connected together.

16. An assembly as set forth in claim 15 including weight material (32) disposed in said weight pocket (30) and being flexible for allowing said sheet means (24) to 17. An assembly as set forth in claim 16 wherein said shaping means (54) comprises a circular hoop (54) for engaging the interior of said sheet means (24) between said floatation pocket (26) and said fluid pocket (34).

18. An assembly as set forth in claim 16 including a baffle (44) inside of said fluid pocket (34) facing said fluid pocket inlet (42).

19. An assembly as set forth in claim 18 wherein said connecting means (52) comprises a plurality of eyelets (52) along each of said first and second ends for lacing said ends together.

* * * * *